US012662818B2

(12) United States Patent
Fuenmayor Calderon et al.

(10) Patent No.: US 12,662,818 B2
(45) Date of Patent: Jun. 23, 2026

(54) TARP SYSTEM AND METHOD FOR SECURING A TARP TO A ROOF OR OTHER STRUCTURE

(71) Applicants: Carlos Eduardo Fuenmayor Calderon, Boca Raton, FL (US); Wilmer Ramon Martin Vasquez, Boca Raton, FL (US)

(72) Inventors: Carlos Eduardo Fuenmayor Calderon, Boca Raton, FL (US); Wilmer Ramon Martin Vasquez, Boca Raton, FL (US)

( * ) Notice: Subject to any disclaimer, the term of this patent is extended or adjusted under 35 U.S.C. 154(b) by 347 days.

(21) Appl. No.: 18/129,210

(22) Filed: Mar. 31, 2023

(65) Prior Publication Data

US 2024/0240462 A1 Jul. 18, 2024

Related U.S. Application Data

(60) Provisional application No. 63/412,130, filed on Sep. 30, 2022.

(51) Int. Cl.
*E04D 5/14* (2006.01)

(52) U.S. Cl.
CPC ..... *E04D 5/145* (2013.01)

(58) Field of Classification Search
CPC ..... E04D 5/145; Y10S 411/923; F16B 15/02; F16B 5/0692
USPC ..... 411/400, 698
See application file for complete search history.

(56) References Cited

U.S. PATENT DOCUMENTS

| | | | | |
|---|---|---|---|---|
| 5,755,545 | A | 5/1998 | Banks | |
| 10,246,889 | B1 | 4/2019 | Nogueras | |
| 10,408,244 | B2 * | 9/2019 | Varga | F16B 5/0692 |
| 11,168,484 | B2 | 11/2021 | Lennox et al. | |
| 11,215,207 | B2 | 1/2022 | Varga | |
| 2002/0095898 | A1 | 7/2002 | Bettencourt | |
| 2004/0154242 | A1 * | 8/2004 | Hudoba | F16B 43/00 52/202 |
| 2006/0185706 | A1 | 8/2006 | Slade | |
| 2007/0266643 | A1 | 11/2007 | Cowvins | |
| 2007/0266645 | A1 * | 11/2007 | Diaz | E04G 21/28 52/23 |
| 2009/0013637 | A1 | 1/2009 | Butler | |

* cited by examiner

*Primary Examiner* — Patrick J Maestri
(74) *Attorney, Agent, or Firm* — John Rizvi; John Rizvi, P.A.—The Patent Professor®

(57) ABSTRACT

A tarp system which can be quickly and easily deployed in place to cover one or more damaged portions on a roof or other structure, and removed for repair of the structure, may include a plurality of fastener assemblies connectable at corresponding fastener openings of a tarp to disconnectably secure the tarp to the structure. Each fastener assembly may include a pair of disks securable on opposite sides of the tarp, to sandwich the tarp. In an illustrative application, the tarp can be extended over one or more damaged portions in the structure. Each fastener assembly may be assembled to engage each corresponding fastener opening and the structure to secure the tarp on the structure. The fastener assemblies can be disassembled and removed from the structure and the respective fastener openings to facilitate removal of the tarp from the structure and repair of the structure.

19 Claims, 8 Drawing Sheets

TARP SYSTEM AND METHOD FOR SECURING A TARP TO A ROOF OR OTHER STRUCTURE

CROSS-REFERENCE TO RELATED APPLICATION

This application claims the benefit of U.S. Provisional Patent Application No. 63/412,130, filed on Sep. 30, 2022, which is incorporated herein by reference in its entirety.

FIELD OF THE INVENTION

The present invention relates generally to tarps, and more particularly, to a tarp system which can be quickly and easily deployed in place to cover one or more damaged portions on a roof and removed for repair of the roof.

BACKGROUND OF THE INVENTION

The roofs and walls of residences, office buildings and other structures are susceptible to direct damage from high winds, rain, hail, or other inclement weather. Damage to roofs and walls may also be indirectly caused by the impact of falling trees, branches, or other objects blown by the wind under storm conditions. Shingled roofs and metal roofs are vulnerable to storm damage. Roofs may also undergo extensive damage from wind or hail impact. Some roof elements may become dislodged completely from the roof during storms having high intensity.

After a storm which causes roof damage has passed, immediate repair of the damaged roof may not be possible. For example, insurance companies may initially require that assessment of the damage, with a view toward determining the cost for the needed repairs, be scheduled. After the repair cost is determined, payment to the building owner may be delayed due to the number of claims which require processing. Once payment is made, the repair crews must be scheduled to perform the repair work. Consequently, throughout the delay period, further damage to the interior of the building through the exposed opening or openings in the roof may be possible. Therefore, a temporary covering for the opening or openings must be provided until the repairs can be completed. Typically, flexible tarpaulins, or "tarps", may be deployed in place over the damaged portion or portions of the roof and secured to the structure using ropes, cords, nails, or other techniques.

A tarp is fabricated of one or more layers of strong, flexible, water-resistant sheet material and closes the opening or openings in the damaged roof from the elements. Tarps may be constructed of polyethylene, canvas, vinyl, or like materials, and may vary in thickness depending on the intended application. In some cases, a tarp may have grommets which are inserted into openings in the tarp along the sides and corners of the tarp. The grommets may provide attachment points for ropes and bungee cords such that the tarp can be placed over the damaged portion or portions of the roof and secured, to protect the covered areas of the roof against weather damage and prevent influx of precipitation into the structure through the roof.

One drawback which is commonly encountered in temporarily covering a damaged roof with a tarp is the difficulty of adequately securing the tarp to the roof or walls such that the tarp is not dislodged by high winds. Moreover, tarps are commonly heavy and difficult to deploy in place. Moreover, in some cases, the grommets in the tarp may not be sufficiently strong to withstand the tension of the ropes or cords under wind load, potentially tearing the fabric portion of the tarp which surrounds the grommet. Third, if the grommet breaks, then it is necessary to replace the grommet, which is difficult without the proper tools.

Additionally, difficulty may be encountered in using the rope or cord to secure the tarp. For example, the rope or cord may not evenly secure the tarp over the damaged portion or portions of the roof unless a large quantity of the rope or cord is used for the purpose. Securing the rope or cord over the tarp in this manner may require unnecessary time since the rope or cord may need to be secured tightly over the roof.

Accordingly, there is a need for a solution to at least one of the aforementioned problems. For example, there is a need for a tarp-securing solution which allows a tarp to be quickly and easily deployed in place to cover one or more damaged portions on a roof and removed for repair of the roof.

SUMMARY OF THE INVENTION

The present invention is directed to a tarp system which can be quickly and easily deployed in place to cover one or more damaged portions on a roof and removed for repair of the roof. Use of the tarp system of the present disclosure is safer than climbing a ladder while carrying sandbags or cement bricks to keep the tarp placed. The tarp system may include a tarp. A plurality of fastener openings may be provided in the tarp. A fastener assembly may be configured to engage each corresponding fastener opening. Each fastener assembly may further be configured to removably engage the roof. Accordingly, in an exemplary application, the tarp can be extended over one or more damaged portions in the roof. Each fastener assembly may be assembled to engage each corresponding fastener opening and the roof to secure the tarp on the roof. The fastener assemblies can be disassembled and removed from the roof and the respective fastener openings to facilitate removal of the tarp from the roof and repair of the roof.

In an illustrative implementation of the invention, a tarp system which can be quickly and easily deployed in place to cover one or more damaged portions on a roof and removed for repair of the roof. The tarp system may include a tarp. The tarp may have a plurality of tarp edges, a plurality of tarp corners, an inner tarp surface and an outer tarp surface. The fastener openings may be provided adjacent to the tarp edges and the tarp corners of the tarp. A fastener assembly may be configured to removably engage each corresponding fastener opening. Each fastener assembly may further be configured to engage the roof. Accordingly, in an exemplary application, the tarp can be extended over one or more damaged portions in the roof. Each fastener assembly may be assembled to engage each corresponding fastener opening and the roof to secure the tarp on the roof. The fastener assemblies can be disassembled and removed from the roof and the respective fastener openings to facilitate removal of the tarp from the roof and repair of the roof.

In a second aspect, the tarp system may be deployed in place on a roof without requiring modification to the roof.

In a second aspect, the tarp may be constructed of polyethylene, canvas, vinyl or like materials.

In another aspect, the plurality of fastener openings may include a plurality of grommet-reinforced fastener openings.

In another aspect, each fastener assembly may include a fastener member. The fastener member may be configured for insertion through each corresponding one of the plurality of fastener openings in the tarp. The fastener member may further be configured to engage the roof.

In another aspect, the fastener member may include an elongated main shaft segment having a first end and a second end. A first end segment may extend from the first end of the main shaft segment. The first end segment may be configured to engage a tile, shingle, or other roof element on the roof. A second end segment may extend from the second end of the main shaft segment. The second end segment may be configured to engage the corresponding fastener opening in the tarp.

In another aspect, each roof element on the roof may have a front edge and a rear edge. The first end segment of the fastener member of each fastener assembly may be configured to engage the rear edge of the roof element.

In another aspect, the first end segment may be disposed at approximately a 90-degree angle with respect to a longitudinal axis of the main shaft segment of the fastener member.

In another aspect, the second end segment may be disposed at approximately a 90-degree angle with respect to the longitudinal axis of the main shaft segment of the fastener member.

In another aspect, each fastener assembly may further include a first disk and second disk. The first disk and the second disk may be configured for deployment and securement on the second end segment of the fastener member. The first disk may be configured to engage the inner tarp surface of the tarp. The second disk may be configured to engage the outer tarp surface of the tarp.

In another aspect, a disk securement device may be configured to secure the first disk and the second disk on the second end segment.

In another aspect, the second end segment of the fastener member may have a plurality of shaft threads. The disk securement device may be configured to engage the shaft threads and tightened against the tarp to secure the tarp between the first disk and the second disk.

In another aspect, the disk securement device may include a threaded nut.

In another aspect, the disk securement device may be a wing nut.

In another aspect, the first disk of each fastener assembly may include a base. An opening may be provided in the base. The opening may be configured to receive the second end segment of the fastener member.

In another aspect, an adhesive may be provided on the base of the first disk. The adhesive may be configured for attachment to the inner tarp surface of the tarp.

In another aspect, a backing sheet may cover the adhesive prior to deployment of the first disk.

In another aspect, the second disk of each fastener assembly may include a base. An opening may be provided in the base. The opening may be configured to receive the second end segment of the fastener member.

In another aspect, an adhesive may be provided on the base of the second disk. The adhesive may be configured for attachment to the outer tarp surface of the tarp.

In another aspect, an backing sheet may cover the adhesive prior to deployment of the second disk.

In another aspect, each fastener assembly may include the first disk and the second disk. The first disk may be configured for attachment to the roof. The second disk may be configured for attachment to the first disk. The tarp may be configured to be sandwiched between the first disk and the second disk.

In another aspect, at least one disk fastener opening may extend through the first disk. At least one first disk fastener may be extended through each corresponding disk fastener opening and threaded into a corresponding first disk fastener opening in the roof.

In another aspect, a second disk fastener may be extended upwardly through the opening and the opening in the respective first disk and second disk. The disk securement device may engage the second disk fastener to secure the second disk on the second disk fastener.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

Figure 1:
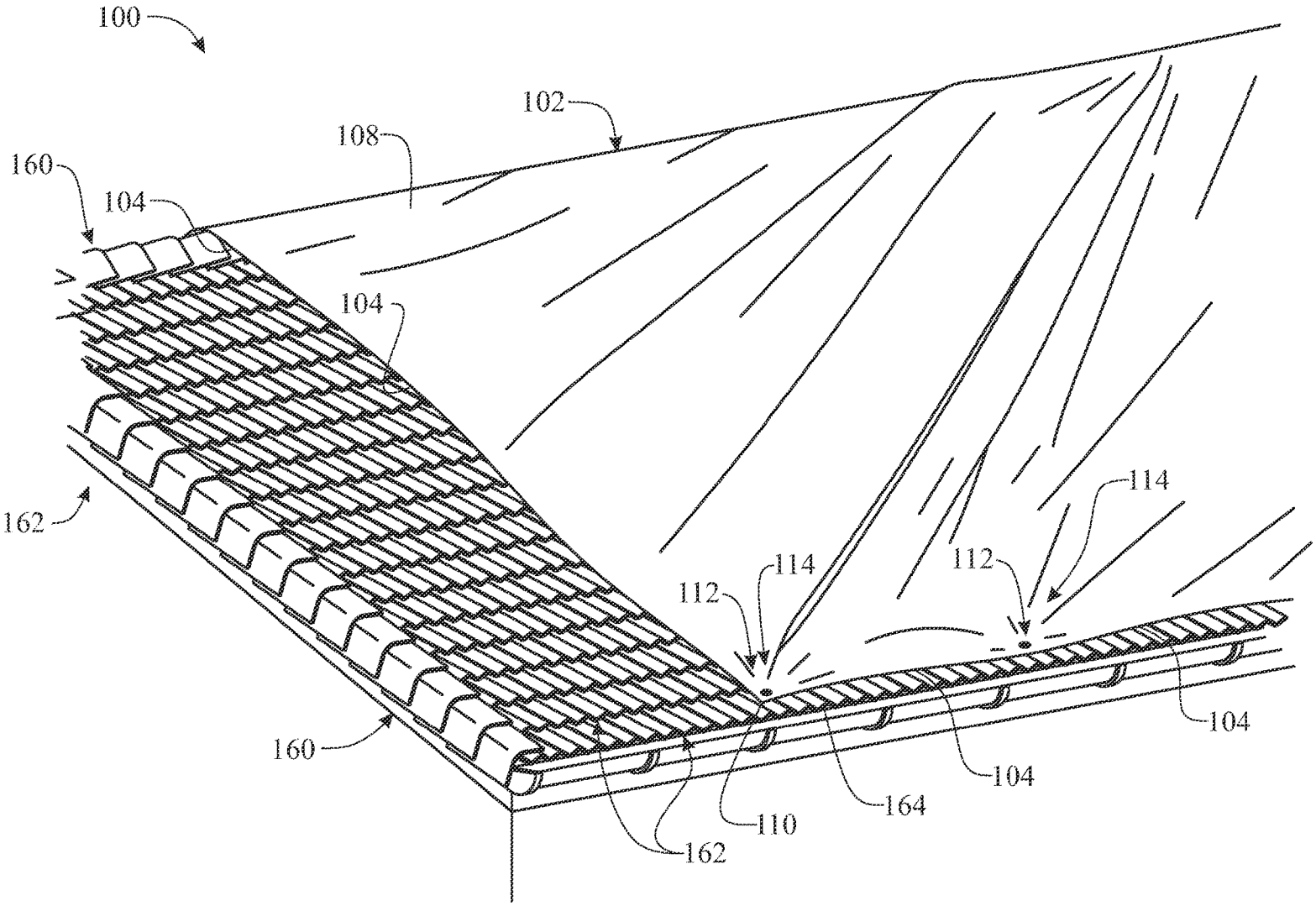
FIG. 1 presents a sectioned perspective view of a tarp system covering a portion of a roof according to a first illustrative embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The present invention is directed toward a tarp system which can be quickly and easily deployed in place to cover one or more damaged portions on a roof and removed for repair of the roof.

Figure 2:
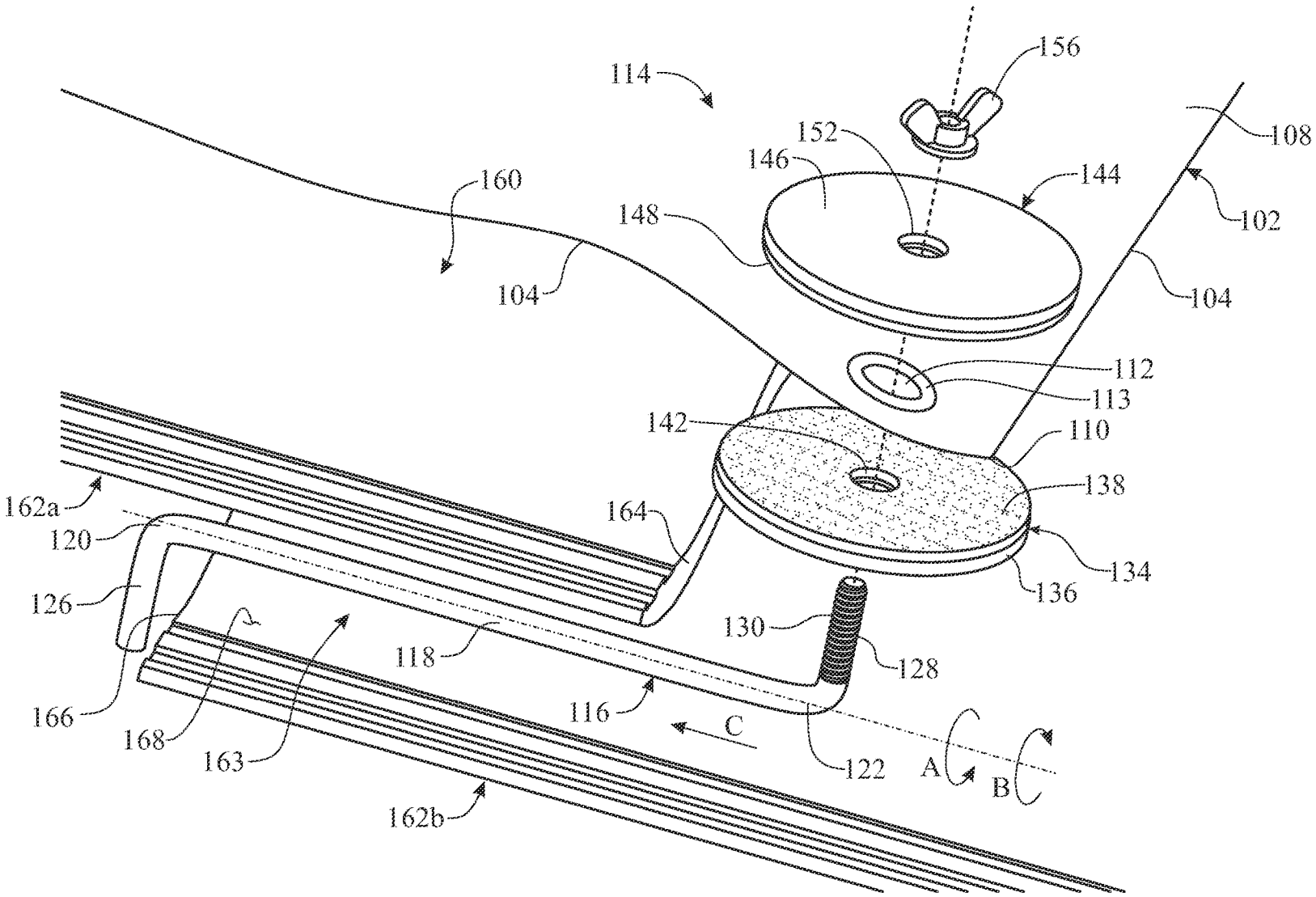
FIG. 2 presents an exploded perspective view of a typical fastener assembly of the tarp system illustrated in FIG. 1.

Referring initially to FIGS. 1-4, a tarp system 100 is illustrated in accordance with a first exemplary embodiment of the present invention. As shown for instance in FIG. 1, the tarp system 100 may include a tarp 102. The tarp 102 may include a plurality of fastener openings 112 (one of which is illustrated in FIG. 2), each provided with a respective fastener assembly 114. Each fastener assembly 114 may be configured to engage each corresponding fastener opening 112 and to further engage a roof 160 or other structure on a house, office building or other construction; for simplicity, the structure to which the tarp system 100 is secured may be hereinafter referred to generically as roof, unless expressly indicated otherwise. Accordingly, in an exemplary application, the tarp 102 can be extended over one or more damaged portions in the roof 160. Each fastener assembly 114 may be assembled to engage each corresponding fastener opening 112 and the roof 160 to secure the tarp 102 on the roof 160. The fastener assemblies 114 can be disassembled and removed from the roof 160 and the respective fastener openings 112 to facilitate removal of the tarp 102 from the roof 160 and repair of the roof 160. The tarp system 100 may be deployed in place on the roof 160 without requiring modification to the roof 160.

Figure 3:
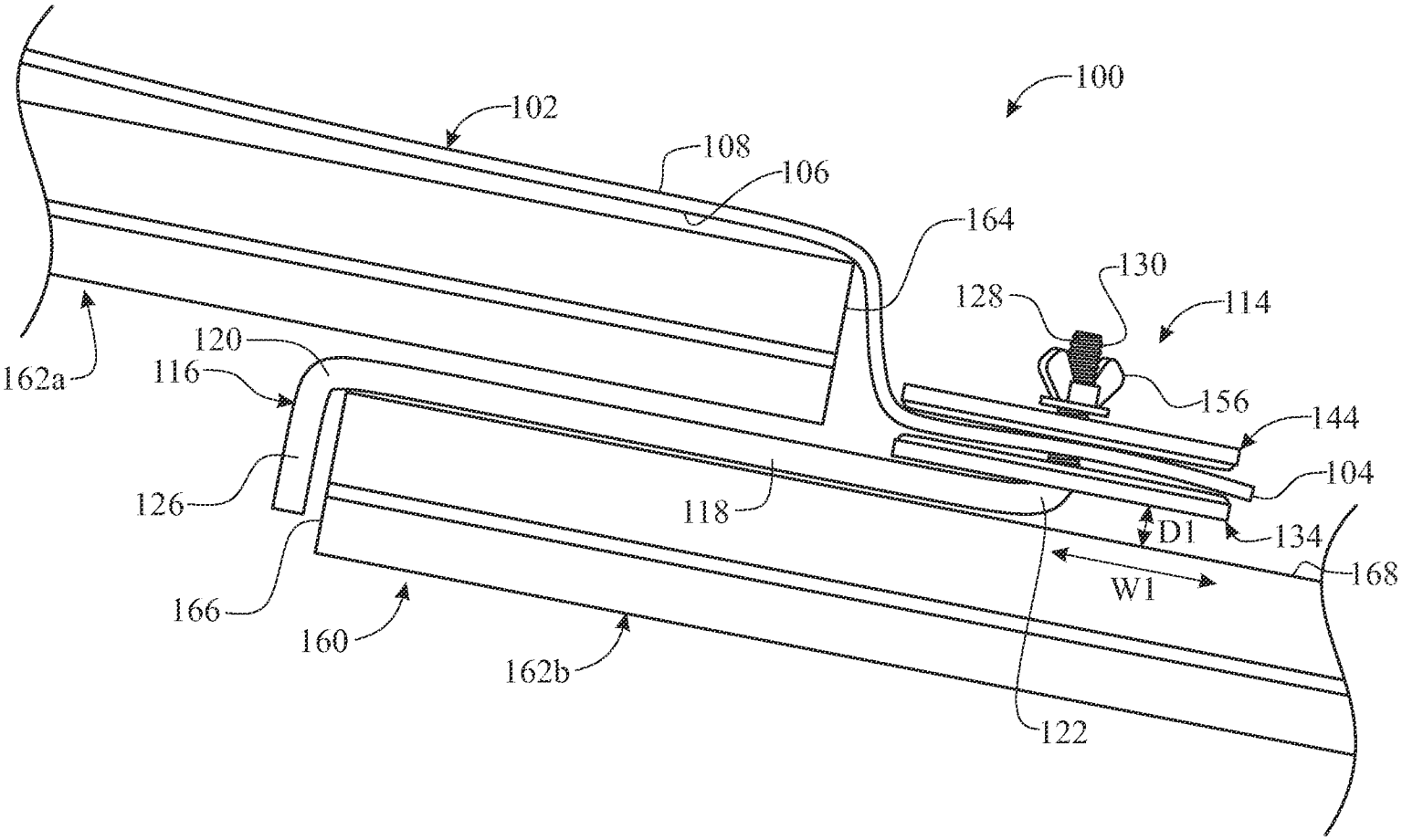
FIG. 3 presents a side view of the fastener assembly illustrated in FIG. 2, securing the tarp to a roof element on the roof.

The tarp 102 may have a plurality of tarp edges 104, a plurality of tarp corners 110, an inner tarp surface 106 and an outer tarp surface 108. In some installations, as shown in FIG. 3, the inner tarp surface 106 may face the roof 160 and the outer tarp surface 108 may face away from the roof 160. The fastener openings 112 may be provided adjacent to the tarp edges 104 and the tarp corners 110 of the tarp 102. The tarp 102 may be constructed of polyethylene, canvas, vinyl, or like flexible and durable materials. Each fastener assembly 114 may be made of different materials, such as according to the type of roof and geographic location. For example and without limitation, in some embodiments, each fastener assembly 114 may be made of aluminum at beachfront locations and may include screws for use on concrete roofs. In some embodiments, the fastener openings 112 may be reinforced by a grommet 113.

Figure 4:
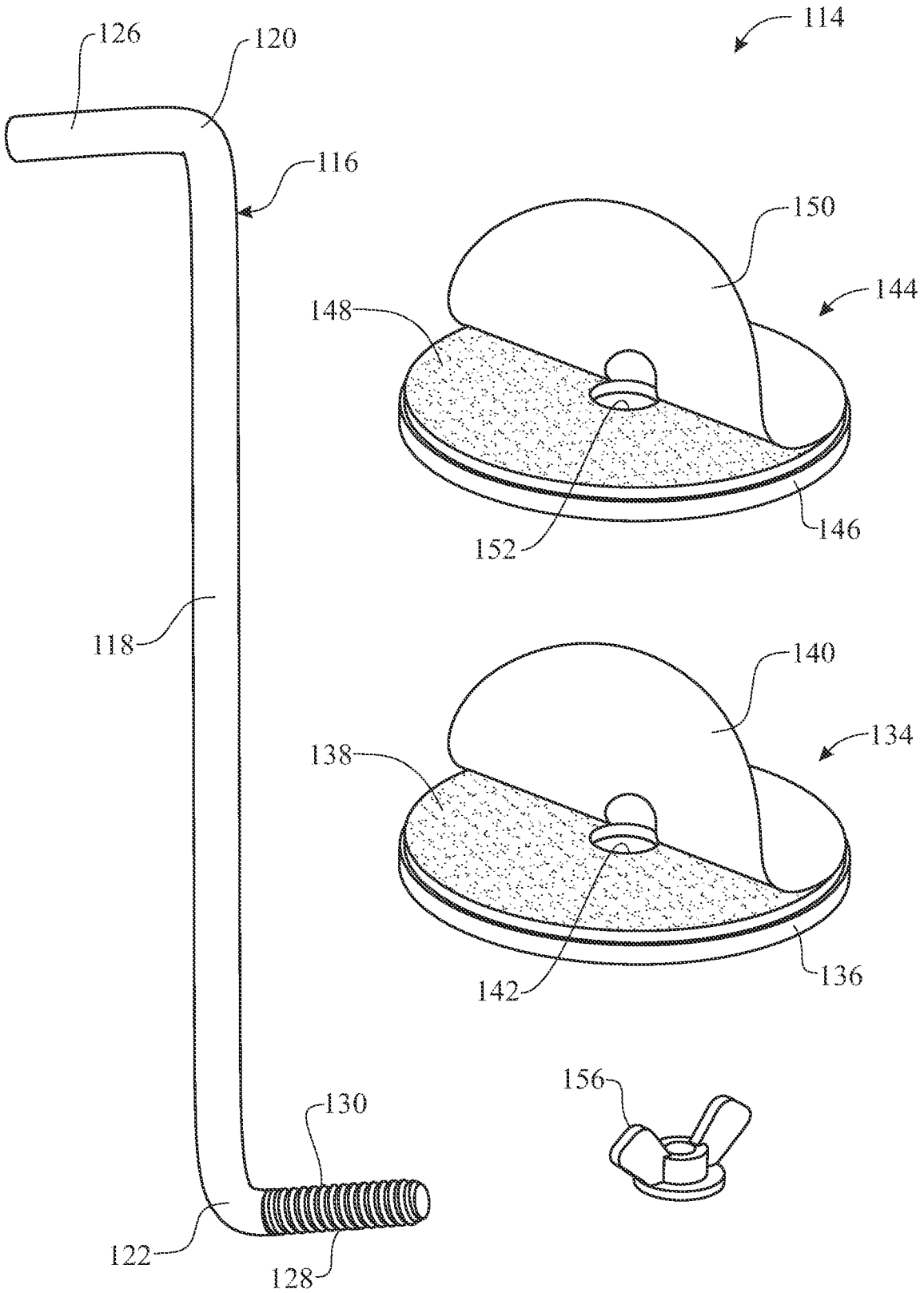
FIG. 4 presents a perspective view of typical fastener member, first disk, second disk and disk fastener components according to an illustrative embodiment of the tarp system.
Figure 5:
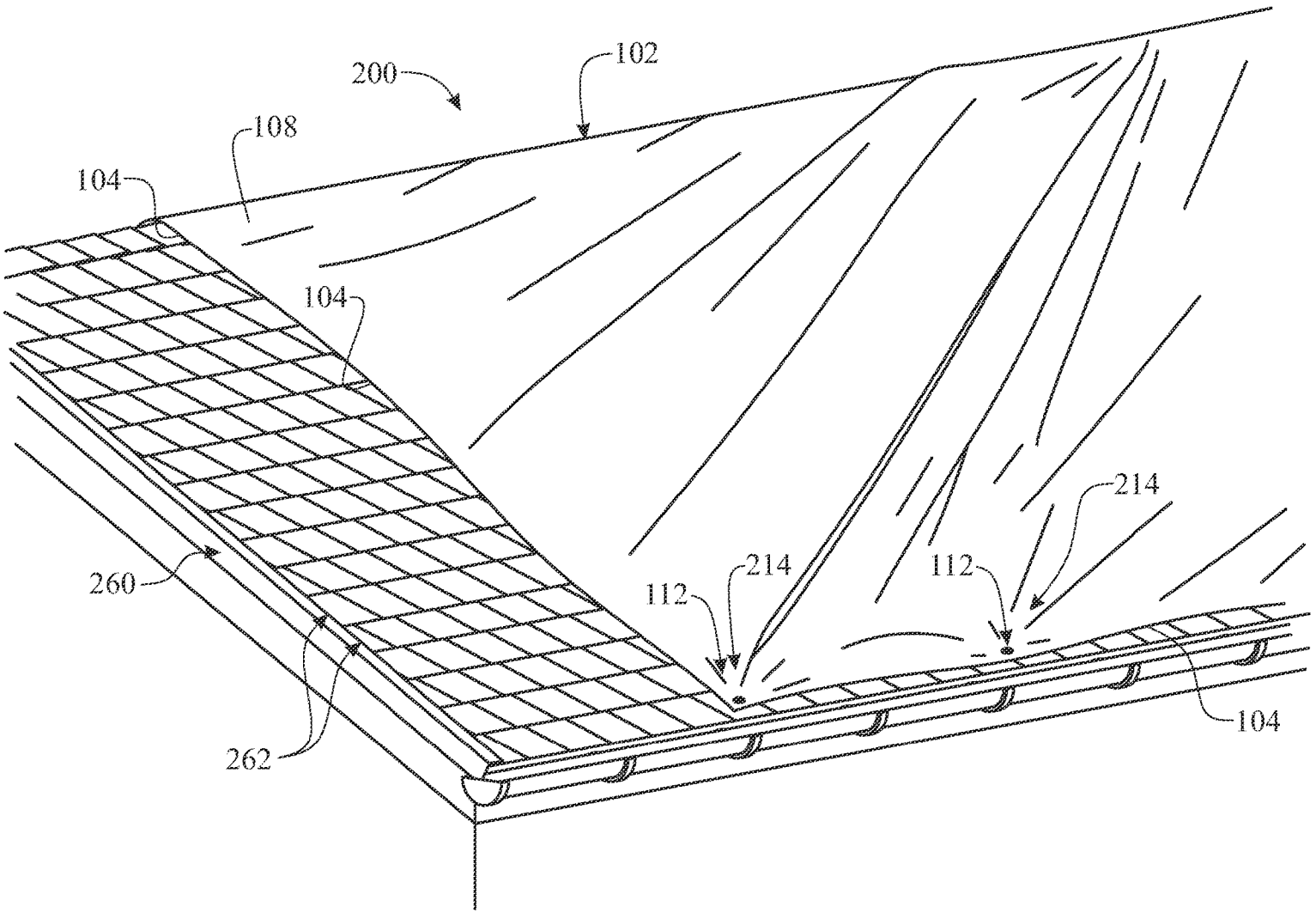
FIG. 5 presents a sectioned perspective view of a tarp system covering a portion of a roof according to a second illustrative embodiment of the present invention.

With reference to FIGS. 2-4, in some embodiments, each fastener assembly 114 may include a fastener member 116. As shown in FIGS. 2 and 3, the fastener member 116 may be configured for insertion through each corresponding fastener opening 112 in the tarp 102. The fastener member 116 may further be configured to engage the roof 160, typically as will be hereinafter described.

The fastener member 116 of each fastener assembly 114 may include an elongated main shaft segment 118. The main shaft segment 118 may have a roof engaging end or first end 120 and an opposite, securement end or second end 122. In some embodiments, such as the present embodiment, the main shaft segment 118 may be generally straight. A roof engaging shaft segment or first end segment 126 may extend from, and at an angle with, the first end 120 of the main shaft segment 118. In some embodiments, such as the present embodiment, the angle formed between the first end segment 126 and the main shaft segment 118 may be approximately or about 90 degrees. The first end segment 126 may be configured to engage a tile, shingle, or other structural roof element 162 on the roof 160. A tarp engaging shaft segment or second end segment 128 may extend from, and at an angle with, the second end 122 of the main shaft segment 118. In some embodiments, the angle formed between the second end segment 128 and the main shaft segment 118 may be approximately or about 90 degrees. The second end segment 128 may be configured to extend through a fastener opening 112 in the tarp 102. In some embodiments, the first end segment 126 and/or the second end segment 128 may be generally straight. Alternatively or additionally, the first end segment 126 and/or the second end segment 128 may be integrally formed with the main shaft segment 118. For instance, the main shaft segment 118 and first and second end segments 126, 128 of the present embodiment are integrally formed into a single piece unit, and are generally straight and connected at an angle with respect to each other. Alternatively or additionally, the first end segment 126 and the second end segment 128 may be coplanar. Alternatively or additionally, the first end segment 126 and the second end segment 128 may extend away from one another, as shown, i.e. forming about 180 degrees with one another. For instance, in the present embodiment, the first end segment 126 and the second end segment 128 are generally straight, parallel to one another, coplanar, perpendicular to the main shaft segment 118, and arranged extending away from each other (i.e. extending from the main shaft segment 118 in opposite directions).

As illustrated in FIGS. 2 and 3, each roof element 162 on the roof 160 may have a front edge 164 and a rear edge 166. The illustrations of FIGS. 2 and 3, which show two of the roof elements 162 (a first or upper roof element and a second or lower roof element, denoted with reference numerals 162*a* and 162*b*, respectively), more specifically illustrate the front edge 164 of the first or upper roof element 162*a* and the rear edge 166 of the second or lower roof element 162*a* arranged below the upper roof element 162*a*. The first end segment 126 of the fastener member 116 of each fastener assembly 114 may be configured to engage the rear edge 166 of a roof element 162. More specifically, as shown in FIG. 3, the first end segment 126 of the fastener member 116 of each fastener assembly 114 may be configured to engage the rear edge 166 of the lower roof element 162*b*, which is arranged below the upper roof element 162*a*, over which the tarp 102 is extended. The main shaft segment 118 may be configured to extend rearward from in front of the front edge 164 of the upper roof element 162*a* to behind the rear edge 166 of the lower roof element 162*b*, between overlapping portions of the upper and lower roof elements 162*a*, 162*b*.

As illustrated in FIGS. 2-4, in some embodiments, each fastener assembly 114 may further include a first washer or disk 134 and second washer or disk 144. The first disk 134 and the second disk 144 may be configured for deployment and securement on the second end segment 128 of the fastener member 116. The first disk 134 may be configured to extend over, and preferably engage, the inner tarp surface 106 of the tarp 102. In some embodiments, at least one of the first and second disks 134 and 144 may be circular; for example, the first and second disks 134 and 144 of the present embodiment are both circular. The second disk may be configured to extend over, and preferably engage, the outer tarp surface 108 of the tarp 102. In some embodiments, such as the present embodiment, the first and second disks 134 and 144 are configured to extend around the entire periphery of the fastener opening 112 and to extend over the inner and outer tarp surfaces 106 and 108, respectively, along the entire periphery of the fastener opening 112. In some embodiments, such as the present embodiment, inner sides of the first and second disks 134 and 144, configured to face one another and face the tarp 102, are generally flat. In some embodiments, the first and second disks 134 and 144 are generally flat.

A disk securement device 156 may be configured to secure the first disk 134 and the second disk 144 on the second end segment 128 of the fastener member 116. In some embodiments, the second end segment 128 of the fastener member 116 may have a threaded portion 130. The disk securement device 156 may be configured to threadingly engage the threaded portion 130 of the second end segment 128 and may be tightened against the tarp 102 to secure the tarp 102 between the first disk 134 and the second disk 144, as illustrated in FIG. 3. In some embodiments, the disk securement device 156 may include a nut, such as a wing nut, for example and without limitation.

As illustrated in FIGS. 2 and 4, the first disk 134 of each fastener assembly 114 may include a base 136. An opening 142 may be provided in and extend through the base 136. In some embodiments, the base 136 may be generally circular, as shown. The opening 142 may be arranged at a center of the base 136. The opening 142 may be configured to receive the second end segment 128 of the fastener member 116. An adhesive 138 may be provided on the optionally flat, inner side of the first disk 134, and more specifically, on an inner side of the base 136 of the first disk 134 configured to face the tarp 102. The adhesive 138 may be configured for attachment to the inner tarp surface 106 of the tarp 102 in deployment of the fastener assembly 114. A backing sheet 140 may initially cover the adhesive 138, and may be removed from the first disk 134 to reveal the adhesive 138, as shown, prior to deployment of the first disk 134 on the inner tarp surface 106 of the tarp 102.

The second disk 144 of each fastener assembly 114 may include a base 146. An opening 152 may be provided in the base 146. In some embodiments, the base 146 may be generally circular, as shown. The opening 152 may be arranged at a center of the base 146. The opening 152 may be configured to receive the second end segment 128 of the fastener member 116. An adhesive 148 may be provided on the optionally flat, inner side of the second disk 144, and more specifically, on an inner side of the base 146 of the second disk 144 configured to face the tarp 102. The adhesive 148 may be configured for attachment to the outer tarp surface 108 of the tarp 102 in deployment of the fastener assembly 114. As illustrated in FIG. 4, an backing sheet 150 may initially cover the adhesive 148, and may be removed from the second disk 144 to reveal the adhesive 148, as shown, prior to deployment of the second disk 144 on the outer tarp surface 108 of the tarp 102.

As best shown in FIG. 4, in some embodiments, such as the present embodiment, the first and second disks 134 and 144 may be interchangeably mountable to the inner and outer tarp surfaces 106 and 108 of the tarp 102, facilitating installation of the tarp system 100. For instance, in an advantageous embodiment, as shown, the first and second disks 134 and 144 may be constructed generally the same, contributing not only to ease of installation but also to a lower overall manufacture cost.

In an illustrative method of operation of the tarp system 100, the tarp system 100 may be deployed on a roof 160 of a home, office building or other structure to temporarily cover one or more damaged portions or areas in the roof 160. As illustrated in FIGS. 2 and 3, the roof 160 may have multiple rows of overlapping roof elements 162. Each roof element 162 may have an exposed front edge 164 and a rear edge 166 which underlies an upper, adjacent overlapping roof element 162. The tarp 102 may initially be spread out over the damaged portion or portions of the roof 160 such that those portions are completely covered by the tarp 102 and are located within the borders of the tarp edges 104 and tarp corners 110.

Each fastener assembly 114 may next be assembled and deployed at each corresponding one or selected ones of the fastener openings 112 in the tarp 102. With reference to FIG. 2, the fastener member 116 of the fastener assembly 114 may be initially arranged in a generally parallel position relative to the roof elements 162*a*, 162*b*, in which the fastener member 116 is rotated sideways with respect to the illustrated position about a central longitudinal axis 119 of the main shaft segment 118, in either direction (for example, in the direction of arrow A). With the fastener member 116 of the fastener assembly 114 turned sideways 90 degrees, the main shaft segment 118 and the first end segment 126 may be inserted into a gap 163 provided between the overlapping adjacent pair of roof elements 162 (formed by lower and upper roof elements 162*b*, 162*a*) on the roof 160, as indicated by arrow C. In some embodiments, the fastener member 116 may be formed generally along a same plane (i.e. the main shaft segment 118, first end segment 126 and second end segment 128 may be generally coplanar), facilitating insertion of the fastener member 116 into and along the gap 163. After a sufficient insertion of the fastener member 116 into the gap 163, the first end segment 126 may eventually overcome, i.e. become arranged rearward of, the rear edge 166 of the lower roof element 162*b*, at which point the fastener member 116 may be rotated 90 degrees in the opposite direction (e.g., in the direction of arrow B) relative to the central longitudinal axis 119 of the main shaft segment 118, back towards the upright position shown in FIG. 2. With the fastener member 116 rotated back to the upright position, the first end segment 126 now extends downwardly and rearward of the rear edge 166 of the bottom roof element 162*b* and blocks a frontward movement, opposite to arrow C, of the fastener member 116 relative to the lower roof element 162*b* and thus relative to the roof 160. In turn, the second end segment 128 is arranged outside of the gap 163 and frontward of the front edge 164 of the upper roof element 162*a*. The second end segment 128 also extends upwardly and, in some embodiments, generally perpendicularly to an outer or upper side 168 of the lower roof element 162*b*. In this upright position, the second end segment 128 is longitudinally (arrow C) secured in place by the blocking effect provided by the first end segment 126 abutting against the rear edge 166 of the bottom roof element 162*b*. To further immobilize the fastener member 116 in this upright position, for example, to minimize or prevent a lateral rotation of the fastener member 116, the operator may softly pull on the fastener member 116 longitudinally frontward (oppositely to arrow C) to increase a friction between the first end segment 126 and the rear edge 166 of the bottom roof element 162*b*. In this stabilized, upright position of the fastener member 116, the second end segment 128 is arranged outside the gap 163 and readily accessible to the operator.

Next, as illustrated in FIG. 4, the backing sheet 140 may be removed from the underlying adhesive 138 on the first disk 134. As illustrated in FIG. 2, with the exposed adhesive 138 facing away from the main shaft segment 118, i.e. upwardly, the first disk 134 may be lowered in place as the second end segment 128 of the fastener member 116 extends through, and protrudes outward (upward) from, the opening 142 of the first disk 134. The tarp 102 may then be lowered in place on the first disk 134 as the fastener opening 112 in the tarp 102 receives the protruding, second end segment 128. The second end segment 128 may be extended through and protrude upward from the fastener opening 112 of the tarp 102. In some embodiments, the inner tarp surface 106 of the tarp 102 may be pressed against the adhesive 138 on the first disk 134 to adhere the tarp 102 to the first disk 134. In some embodiments, the opening 142 of the first disk 134 may be non-threaded and configured to allow for a rapid, axial insertion of the second end segment 128 therethrough, facilitating installation of the tarp system 100. In other embodiments, the opening 142 of the first disk 134 may be threaded and configured to thread onto the threaded portion 130 of the second end segment 128, allowing to adjustably secure the first disk 134 to the second end segment 128.

As further illustrated in FIG. 4, the backing sheet 150 may next be removed from the adhesive 148 of the second disk 144. The second disk 144 may be inverted and, with the exposed adhesive 148 facing towards the main shaft segment 118 of the fastener member 116 (i.e., downwardly), lowered in place as the second end segment 128 of the fastener member 116 inserts through, and eventually protrudes upward from, the opening 152 of the second disk 144. In some embodiments, the adhesive 148 on the second disk 144 may be pressed against the outer tarp surface 108 of the tarp 102 to adhere the second disk 144 to the tarp 102. In some embodiments, the opening 152 of the second disk 144 may be non-threaded and configured to allow for a rapid, axial insertion of the second end segment 128 therethrough, facilitating installation of the tarp system 100. In other embodiments, the opening 152 of the second disk 144 may be threaded and configured to thread onto the threaded portion 130 of the second end segment 128, allowing to adjustably secure the second disk 144 to the second end segment 128.

As shown in FIGS. 2 and 3, the first and second disks 134 and 144 and the tarp 102 are configured to fit over the second end segment 128, with the tarp 102 sandwiched between the first and second disks 134 and 144. The first and second disks 134 and 144 are preferably securable against the tarp 102 to enhance this sandwiching effect. For instance, as mentioned heretofore, the openings 142 and/or 152 may be configured to thread onto the threaded portion 130 of the second end segment 128. Alternatively or additionally, the disks 134, 144 may be provided with the aforementioned adhesives 138, 148. Alternatively or additionally, as illustrated in FIGS. 2 and 3, in some embodiments, with the second end segment 128 extending through the openings 142, 112 and 152 of the first disk 134, tarp 102, and second disk 144, respectively, and the threaded portion 130 of the second end segment 128 protruding outwardly (upwardly) from the opening 152 of the second disk 144, the disk securement device 156 may then be threaded on the threaded portion 130 and tightened against the base 146 of the second disk 144 to relatively tightly sandwich the tarp 102 between the first disk 134 and the second disk 144.

With continued reference to FIGS. 2 and 3, once the first and second disks 134 and 144 are secured to the second end segment 128, the fastener assembly 114 may form a generally rigid unit. In some embodiments, the assembly of the first and second disks 134 and 144 may be separated from an upper side 168 of the lower roof element 162*b* a distance "D1", which may be optionally defined by a diameter or thickness of the main shaft segment 118. In some embodiments, such as the present embodiment, the distance "D1" may allow for a slight rotation of the fastener assembly 114 about the central longitudinal axis 119 of the main shaft segment 118, which may allow to absorb a certain amount of energy from the tarp 102 in the event of some tarp movement. In preferred embodiments, such as the present embodiment, the width "W1" (e.g., radius) of the assembly formed by the first and second disks 134 and 144 may be sufficiently greater than the distance "D1" to prevent a joint, 90 degree rotation of the fastener assembly 114 about the central longitudinal axis 119 in either direction (arrows A or B); for example, in the depicted embodiment, the width "W1" is about four times the height "D1". By preventing a full 90-degree rotation of the fastener assembly 114, the first end segment 126 of the fastener member 116 is prevented from unlocking from the rear edge 166 of the lower roof element 162*b*, and the fastener assembly 114 thereby remains locked in place and unable to slide out of the gap 163 during use of the tarp 102.

In the foregoing manner or manners, each fastener assembly 114 may be deployed to securely attach the tarp 102 to a roof element 162 on the roof 160 at each or selected ones of the fastener openings 112 in the tarp 102. The fastener assemblies 114 therefore safely secure the tarp 102 over the damaged portion or portions of the roof 160 to prevent rainwater and other precipitation from entering the structure through the damaged roof 160.

At the time when the damaged roof 160 is to be repaired, the fastener assemblies 114 may be disassembled typically by reversing the steps described above. The tarp 102 may then be lifted and removed from the roof 160 for repair of the roof 160.

The illustrations of FIGS. 5-8 show a tarp system 200 in accordance with a second exemplary embodiment the present invention. In the tarp system 200, elements which are analogous to the respective elements of the tarp system 100 that was heretofore described with respect to FIGS. 1-4 are designated by the same respective numerals.

Figure 6:
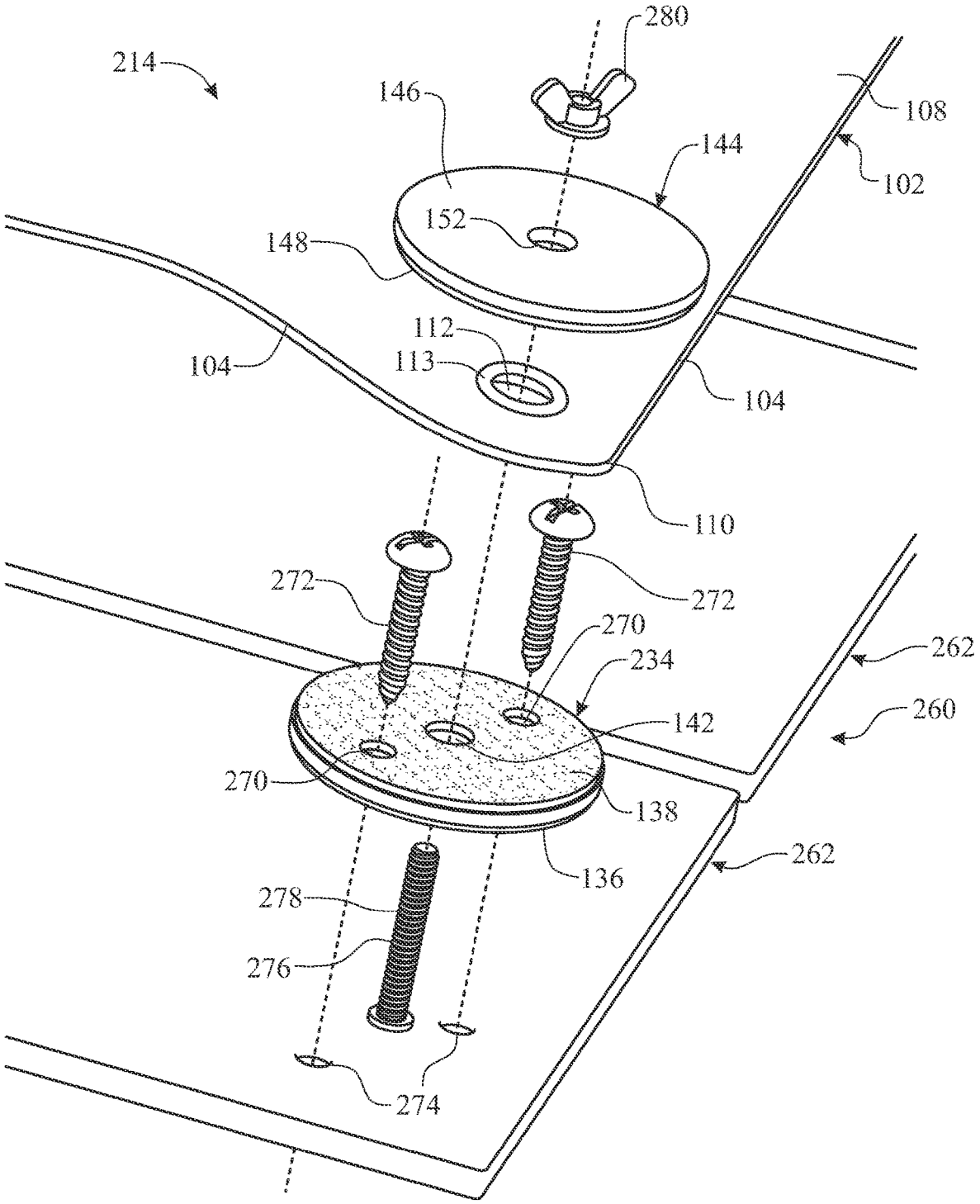
FIG. 6 presents an exploded perspective view of a typical fastener assembly of the tarp system illustrated in FIG. 1.
Figure 7:
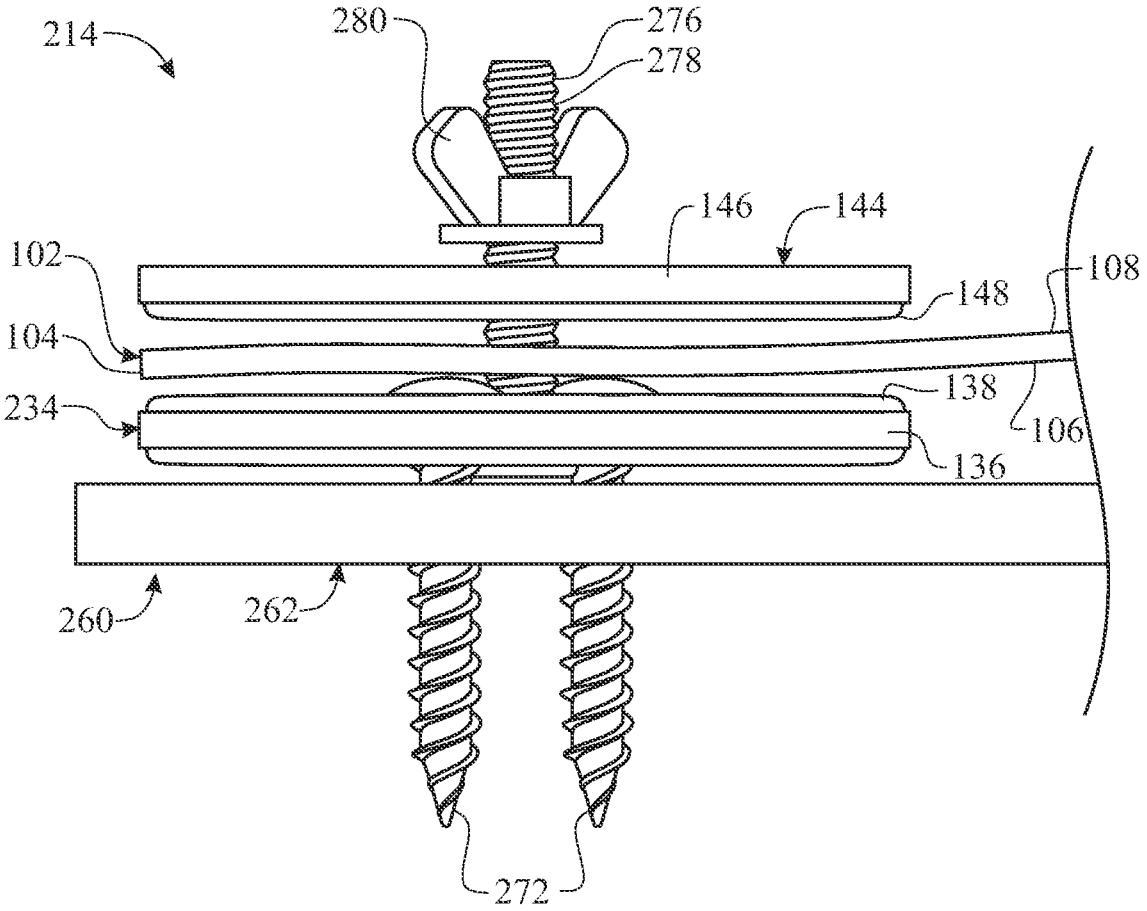
FIG. 7 presents a side view of the fastener assembly illustrated in FIG. 6, securing the tarp to a roof element on the roof.
Figure 8:
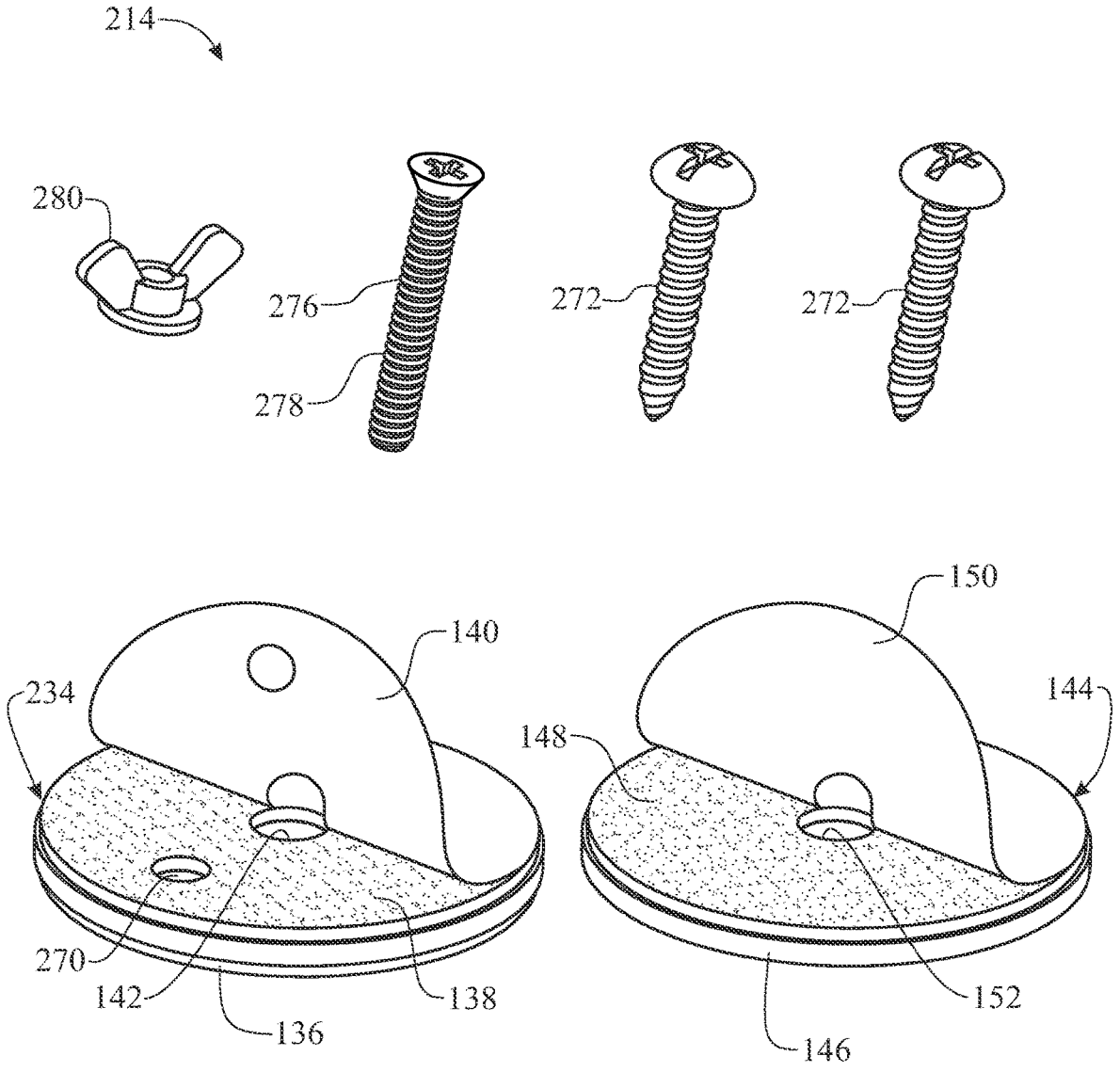
FIG. 8 presents a perspective view of typical fastener member, first disk, second disk, first disk fastener, second disk fastener and disk securement device components according to an illustrative embodiment of the tarp system.

Similarly to the previous embodiment, the tarp system 200 of the present embodiment may include a plurality of fastener assemblies 214 configured to attach to respective fastener openings 112 of the tarp 102 and to secure the tarp 102 to a roof 260, which may be formed of one or more roof elements 262. As illustrated in FIGS. 6-8, each fastener assembly 214 of the tarp system 200 may include a first washer or disk 234, and a second washer or disk, which may be the same as that of the previous embodiment and is thus referred to hereinafter as second disk 144. In the tarp system 200 of the present embodiment, the first disk 234 may be configured for attachment to the roof 260. The second disk 144 may be configured for attachment to the first disk 234. Similarly to the previous embodiment, the tarp 102 may be configured to be sandwiched between the first disk 234 and the second disk 144. Similarly to the previous embodiment, inner sides of the first and second disks 234, 144 configured to face one another may be flat. For example, in the present embodiment, both disks 234, 144 are formed as generally flat, disk-shaped bodies.

As illustrated in FIG. 6, at least one disk fastener opening 270 may extend through the first disk 234. At least one first disk fastener 272 may be extended through each corresponding disk fastener opening 270. In installation of the tarp system 200, each first disk fastener 272 may be threaded into a corresponding first disk fastener opening 274.

The tarp system 200 may include a second disk fastener 276, which may be attached to the roof 260 such that the second disk fastener 276 extends upward, such as perpendicularly from, the roof 260. The second disk fastener 276 is configured to extend through the opening 142 in the first disk 234, the fastener opening 112 of the tarp 102, and the opening 152 in the second disk 144. The tarp system 200 further includes a disk securement device 280 configured to attach to (e.g., threadingly engage) the second disk fastener 276 to secure the second disk 144 on the second disk fastener 276, similarly to as was heretofore described with respect to the disk securement device 156.

As illustrated in FIG. 6, in typical installation of the tarp 102 on the roof 260, each fastener assembly 214 may be assembled and deployed by initially extending the second disk fastener 276 upwardly through the opening 142 in the first disk 234—with the exposed adhesive 138 of the first disk 234 facing upwardly, in some embodiments—. The second disk fastener 276 may have been previously fastened to, or extended through, the roof 260, and positioned extending upward from the roof 260. Once the first disk 234 is fitted over the second disk fastener 276, the first disk 234 may be attached to a roof element 262 on the roof 260, typically by extending the first disk fasteners 272 through the respective disk fastener openings 270 in the first disk 234 and threading and tightening the first disk fasteners 272 in the respective first disk fastener openings 274 in the roof element 262. In some embodiments, the first disk fastener openings 274 may have been previously formed in the roof 260; in other embodiments, the first disk fastener openings 274 may be formed by the threading of the first disk fasteners 272 into the roof 260. With the first disk 234 secured against the roof 260 and the second disk fastener 276 protruding upward from the opening 142 of the first disk 234, the tarp 102 may then be lowered in place onto the first disk 234 as the fastener opening 112 in the tarp 102 receives the protruding, second disk fastener 276. The tarp 102 may be pressed against the first disk 234. In some embodiments, the inner tarp surface 106 of the tarp 102 may be adhered to the exposed adhesive 138 on the first disk 234. The second disk 144 may then be lowered in place as the opening 152 receives the second disk fastener 276—in some embodiments, this may be done with the second disk 144 inverted and with the exposed adhesive 148 facing downwardly—. The second disk 144 may be pressed against the tarp 102. In some embodiments, the adhesive 148 allows the outer tarp surface 108 to adhere to the second disk 144. With the second disk 144 mounted on the tarp 102, the threaded portion 278 of the second disk fastener 276 may protrude outwardly (upward) from the opening 152 of the second disk 144. The disk securement device 280 may be threaded onto the protruding, threaded portion 278 of the second disk fastener 276 and adjustably abut against the second disk 144 to press the second disk 144 against the tarp 102 and further against the first disk 234 and the roof 260, allowing to immobilize the area of the fastener opening 102 of the tarp 102 with respect to the roof 260 and thereby secure the tarp 102.

At the time when the damaged roof 260 is to be repaired, the fastener assemblies 214 may be disassembled typically by reversing the steps described above. The tarp 102 may then be lifted and removed from the roof 260 for repair of the roof 260.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A tarp system deployable to at least partially cover a structure, comprising:

a plurality of fastener assemblies, wherein each fastener assembly is configured to engage a respective fastener opening of a plurality of fastener openings of a tarp and to secure an area of the tarp adjacent to the respective fastener opening to a structure, and further wherein each fastener assembly comprises a first disk, a second disk, and a fastener, the first and second disks comprising respective openings configured to receive the fastener therethrough, wherein each one of the first disk and the second disk comprises a respective inner side, wherein at least one of the inner side of the first disk and the inner side of the second disk comprises an adhesive; wherein the tarp system is configured to adopt an assembled configuration in which the respective fastener opening and the area of the tarp adjacent to the respective fastener opening are sandwiched between the first and second disks, and the inner sides of the first and second disks are arranged facing one another and facing the tarp, and the adhesive of said at least one of the inner side of the first disk and the inner side of the second disk is adhered to the tarp, and further in which the fastener of said each fastener assembly is secured to the structure and extends through the openings of the first and second disks and the respective fastener opening of the tarp, and further in which the fastener of said each fastener assembly secures the first and second disks against the sandwiched, area of the tarp adjacent to the respective fastener opening and further secures the first and second disks to the structure.

2. The tarp system of claim 1, wherein each one of the first disk and the second disk extends around the respective opening of said each one of the first and second disks about a full periphery of said respective opening.

3. The tarp system of claim 1, wherein at least one of the first and second disks is circular.

4. The tarp system of claim 1, wherein the respective inner side of each one of the first disk and the second disk is generally flat.

5. The tarp system of claim 4, wherein the first and second disks are generally flat.

6. The tarp system of claim 1, wherein the fastener of said each fastener assembly comprises a threaded fastener member and a disk securement device threadably connectable to the threaded fastener member, and further wherein, in the assembled configuration of the tarp system, the disk securement device of said each fastener assembly is threaded to the threaded fastener member of said each fastener assembly and maintains the first and second disks sandwiching the area of the tarp adjacent to the respective fastener opening.

7. The tarp system of claim 6, wherein the threaded fastener member of said each fastener assembly comprises a main shaft segment, a first end segment, and a second end segment, the first and second end segments extending from opposite ends of the main shaft segment and at respective angles with the main shaft segment, the second end segment comprising a threaded portion, and further wherein, in the assembled configuration of the tarp system, the main shaft segment, the first end segment, and the second end segment are jointly arranged in a locked configuration in which the threaded portion protrudes outward from the structure, and the first end segment abuts against the structure preventing a displacement of the fastener with respect to the structure, and wherein, in the assembled configuration, the disk securement device is threaded to the threaded portion.

8. The tarp system of claim 7, wherein the main shaft segment, the first end segment and the second end segment are generally coplanar.

9. The tarp system of claim 7, wherein the main shaft segment is generally straight, and the first and second end segments extend from the main shaft segment at about 90 degrees with the main shaft segment and in opposite directions relative to one another.

10. The tarp system of claim 9, wherein the main shaft segment, the first end segment and the second end segment are jointly rotatable about a central longitudinal axis of the main shaft segment to selectively adopt:

the locked configuration, and an unlocked configuration, in which the first end segment does not abut against the structure and the fastener is thereby freed to displace with respect to the structure.

11. The tarp system of claim 10, wherein, in the assembled configuration of the tarp system, the main shaft segment, the first end segment and the second end segment are blocked from jointly rotating from the locked configuration to the unlocked configuration by the structure blocking a rotation of at least one of the first and second disks jointly with the main shaft segment, the first end segment and the second end segment.

12. The tarp system of claim 6, wherein, in the assembled configuration of the tarp system, a threaded portion of the threaded fastener member of said each fastener assembly protrudes outward from the openings of the first and second disks and the respective fastener opening of the tarp, away from the structure, and the disk securement device is threaded to the protruding, threaded portion.

13. The tarp system of claim 6, wherein the disk securement device comprises a threaded nut.

14. The tarp system of claim 1, further comprising the tarp.

15. A tarp system deployable to at least partially cover a structure, comprising:

a plurality of fastener assemblies, wherein each fastener assembly is configured to engage a respective fastener opening of a plurality of fastener openings of a tarp and to secure an area of the tarp adjacent to the respective fastener opening to a structure, and further wherein each fastener assembly comprises a first disk, a second disk, and a fastener, the first and second disks comprising respective openings configured to receive the fastener therethrough; wherein the fastener of said each fastener assembly comprises a threaded fastener member and a disk securement device threadably connectable to the threaded fastener member, wherein the threaded fastener member of said each fastener assembly comprises a main shaft segment, a first end segment, and a second end segment, the first and second end segments extending from opposite ends of the main shaft segment and at respective angles with the main shaft segment, the second end segment comprising a threaded portion; wherein the tarp system is configured to adopt an assembled configuration in which the respective fastener opening and the area of the tarp adjacent to the respective fastener opening are sandwiched between the first and second disks, and the fastener of said each fastener assembly is secured to the structure and extends through the openings of the first and second disks and the respective fastener opening of the tarp, and further in which the fastener of said each fastener assembly secures the first and second disks against the sandwiched, area of the tarp adjacent to the respective fastener opening and further secures the first and second disks to the structure; and further wherein in the assembled configuration, the disk securement device of said each fastener assembly is threaded to the threaded portion of the second end segment of the threaded fastener member of said each fastener assembly and maintains the first and second disks sandwiching the area of the tarp adjacent to the respective fastener opening, and the main shaft segment, the first end segment, and the second end segment are jointly arranged in a locked configuration in which the threaded portion protrudes outward from the structure, and the first end segment abuts against the structure preventing a displacement of the fastener with respect to the structure.

16. The tarp system of claim 15, wherein the main shaft segment, the first end segment and the second end segment are generally coplanar.

17. The tarp system of claim 15, wherein the main shaft segment is generally straight, and the first and second end segments extend from the main shaft segment at about 90 degrees with the main shaft segment and in opposite directions relative to one another.

18. The tarp system of claim 17, wherein the main shaft segment, the first end segment and the second end segment are jointly rotatable about a central longitudinal axis of the main shaft segment to selectively adopt:

the locked configuration, and an unlocked configuration, in which the first end segment does not abut against the structure and the fastener is thereby freed to displace with respect to the structure.

19. The tarp system of claim 18, wherein, in the assembled configuration of the tarp system, the main shaft segment, the first end segment and the second end segment are blocked from jointly rotating from the locked configuration to the unlocked configuration by the structure blocking a rotation of at least one of the first and second disks jointly with the main shaft segment, the first end segment and the second end segment.

* * * * *